US007070397B2

(12) United States Patent
Narney, II et al.

(10) Patent No.: US 7,070,397 B2
(45) Date of Patent: Jul. 4, 2006

(54) COMPRESSOR SUCTION GAS FEED ASSEMBLY

(75) Inventors: John Kenneth Narney, II, Bristol, VA (US); David Turner Monk, Bristol, VA (US); Benjamin Alan Majerus, Bristol, VA (US); William Terry Addison, Bristol, TN (US)

(73) Assignee: Bristol Compressors, Inc., Bristol, VA (US)

( * ) Notice: Subject to any disclaimer, the term of this patent is extended or adjusted under 35 U.S.C. 154(b) by 265 days.

(21) Appl. No.: 10/427,022

(22) Filed: Apr. 30, 2003

(65) Prior Publication Data

US 2004/0219033 A1 Nov. 4, 2004

(51) Int. Cl.
*F04B 39/00* (2006.01)

(52) U.S. Cl. ..... 417/312; 417/572; 417/415; 417/366; 417/371; 181/403

(58) Field of Classification Search ..... 417/902, 417/312, 572, 415, 366, 371; 181/403
See application file for complete search history.

(56) References Cited

U.S. PATENT DOCUMENTS

| | | | | |
|---|---|---|---|---|
| 3,189,258 | A | 6/1965 | Larsen | |
| 4,384,635 | A | 5/1983 | Lowery | |
| 4,573,880 | A | 3/1986 | Hirano et al. | |
| 4,729,723 | A | 3/1988 | Outzen | |
| 5,281,105 | A | 1/1994 | Osaka et al. | |
| 5,328,338 | A | 7/1994 | Hirano et al. | |
| D366,488 | S | 1/1996 | Alfano et al. | |
| 5,487,648 | A | 1/1996 | Alfano et al. | |
| 5,538,404 | A * | 7/1996 | DiFlora et al. | 417/312 |
| 5,997,258 | A * | 12/1999 | Sawyer et al. | 417/312 |
| 6,035,963 | A | 3/2000 | Wollitz | |
| 6,254,354 | B1 | 7/2001 | Sonnier, Jr. et al. | |
| 6,379,130 | B1 * | 4/2002 | Shafer | 417/423.14 |
| 6,776,589 | B1 * | 8/2004 | Tomell et al. | 417/415 |

* cited by examiner

*Primary Examiner*—Tae Jun Kim
*Assistant Examiner*—Ryan Gillan
(74) *Attorney, Agent, or Firm*—McNees Wallace & Nurick LLC

(57) ABSTRACT

Suction gas feed assemblies to provide gas to a hermetic compressor are provided. The feed assemblies have capacity for reducing suction noise resulting from suction conduit vibration, valving operation, suction gas pulsing, or the like. The suction gas feed assemblies include a suction plenum in the form of a substantially cylindrical end cap or motor cap having substantially straight side wall, a contoured top wall, and a gas inlet aperture and suction conduit aperture which are configured to provide strong suction and motor cooling, with reduced superheat, suction pulsation, and noise attenuation. The motor cap has excellent structural stiffness and low sound radiation.

24 Claims, 7 Drawing Sheets

COMPRESSOR SUCTION GAS FEED ASSEMBLY

BACKGROUND OF THE INVENTION

This invention concerns refrigeration or air conditioning compressor units of the hermetically sealed type wherein the compressor housing or "shell" encloses the compressor, its drive motor and accessories. In particular, the invention concerns suction gas feed systems utilizing a motor cap as a suction intake to provide gas to the compressor.

Hermetically sealed compressors of the reciprocating type typically incorporate a compressor assembly which encloses the pistons, cylinders, and related compressor parts. A piston crankshaft typically extends from one end of the assembly, and is attached to a motor rotor of an electric motor. One or more stators are provided in proximity to the rotor, with an air gap formed between the rotor and the stator. Setting of this air gap is important to provide proper motor performance for suction and compressor operation in most compressors. In addition, suction gas feed systems often employ a suction gas intake plenum from which conduits convey the gas to the intake mechanism of the compressor assembly such as suction valving for the cylinders. Some examples of such systems are shown in U.S. Pat. Nos. 4,105,374; 4,174,189; 4,236,092; 4,239,461; 4,412,791; 4,503,347; 4,591,318, and 5,538,404.

The suction gas intake plenum may be provided by a number of assemblies and methods. In hermetic compressors, the intake plenum is often provided by a motor cap or shroud (hereinafter "motor cap") covering the end of the driving motor opposite the shaft. Where a motor cap is provided, it is necessary to provide an inlet or opening in the motor cap to facilitate gas intake for suction by the compressor. Use of a motor cap provides several advantages, such as cooling the motor by directing suction gas across the motor, as well as attenuating suction noise such as from pressure pulses produced by the compressor. For additional sound attenuation, it is well known that suction mufflers or other noise attenuators can be mounted in-line in the suction conduit systems, as shown in U.S. Pat. Nos. 3,101,891; 3,645,358; 3,864,064; 4,239,461; and 5,538,404. The utility disclosures of the above-listed patents are incorporated herein by reference.

However, the prior constructions of suction gas feed assemblies do not provide a high degree of noise attenuation and efficient performance. For example, where motor caps are provided, they are primarily cylindrical in shape, which shape produces the undesirable result of providing excess volume in undesirable areas of gas flow that results in increased superheat and poor motor cooling. Superheat occurs when the suction gas temperature is elevated above the desired temperature, and can be caused by the gas absorbing too much heat from the motor before returning to the compressor. Superheat results in inefficiency in compression since more energy must be expended to lower the elevated gas temperature. The flexibility of the cylindrical shape of known motor caps also results in insufficient stiffness which produces increased noise radiation, and which compromises performance when the motor cap is used as a transportation stop within the top of the compressor assembly. In addition to poor stiffness and poor sound insulation properties, the substantially flat top walls of known cylindrical motor caps also require flat top compressor shell housings, which housings exhibit low stiffness and provide an undesirably high surface areas for sound transmission.

Therefore, what is needed is an improved construction and assembly of suction gas feed assemblies in compressors, particularly in small hermetically sealed, reciprocating units. What is further needed is a motor cap which provides strong suction, minimized superheat, and adequate motor cooling, while providing increased structural stiffness and decreased sound radiation.

SUMMARY OF THE INVENTION one embodiment of the present invention, the apparatus is a suction gas feed assembly for a gas compressor unit having an electric motor which drives a piston type compressor. One end of the motor is interconnected with and adjacent the piston crankshaft to drive the compressor mechanism, while the other end of the motor is substantially unencumbered. The suction feed assembly of this embodiment includes a motor cap or shroud having a circumferential sidewall which blends into a top wall to form a generally cylindrical, inverted bowl-shaped closed end. The other end of the generally cylindrical motor cap includes a generally circular open end ("opening") that is configured for substantial sealing contact with the unencumbered end of the motor. The sidewalls further include a gas inlet aperture for the entry of gas into the cap, and a suction conduit aperture adapted to receive a suction conduit that provides passage for the gas to the porting or valving of the compressor assembly.

In another embodiment, the end cap includes a sidewall and closed top wall, the top wall being contoured and having protruding portions and recessed portions which together function to control and direct gas flow to provide strong suction, minimized superheat, and adequate motor cooling, while providing increased structural stiffness and decreased sound radiation.

In yet another embodiment, the end cap has a profile that incorporates substantially spherical dimensional parameters to minimize cap size while maximizing strength and stiffness, reducing the surface area for sound radiation, and permitting use of a compressor housing having generally spherical or cylindrical dimensional parameters to reduce overall size of the compressor unit.

In a further embodiment, the gas inlet aperture is provided along a substantially vertical panel portion of the sidewall, which is adjacent to a bridge-shaped portion of the top wall. In this embodiment, the aperture and the adjacent top wall and sidewall portions are positioned, aligned, sized and shaped so as to provide strong suction, minimized superheat, and adequate motor cooling, while providing increased structural stiffness and decreased sound radiation.

One advantage of the invention is that it accommodates many types of presently manufactured compressors, including single or multiple cylinder compressors, their motors and the aforesaid auxiliary components.

Another advantage of the invention is that it provides increased capacity for precise alignment of the gas inlet aperture with the gas return aperture of the compressor housing to producing strong suction, minimized superheat, and adequate motor cooling.

Another advantage of the present invention is that the configuration of the motor cap of the present invention increases structural stiffness, while decreasing vibration and sound radiation.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

The invention will be further understood from the following description and drawings which show a preferred embodiment of the present invention, wherein.

Wherever possible, the same reference numbers will be used throughout the drawings to refer to the same or like parts.

DESCRIPTION OF PREFERRED EMBODIMENTS

The motor cap of the present invention preferably has a generally cylindrical shape, and is dimensioned to accommodate attachment to an electric motor and suction line conduit in a typical hermetic compressor unit such as the compressor unit shown in U.S. Pat. No. 5,538,404 (the disclosure of which is incorporated herein by reference) to form a suction gas feed assembly.

Figure 1:
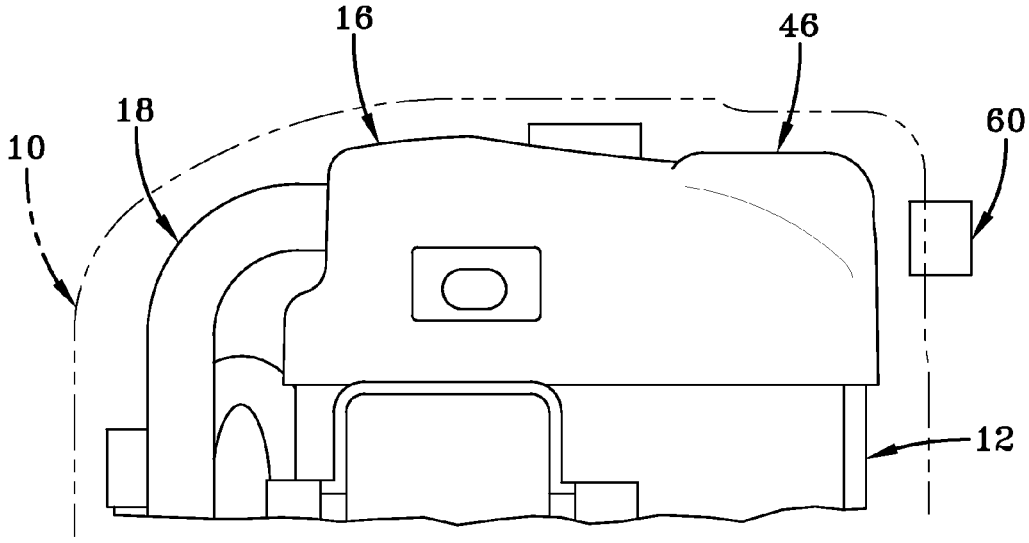
FIG. 1 is a side perspective view of the motor cap of the present invention installed in a hermetically sealed compressor unit.
Figure 2:
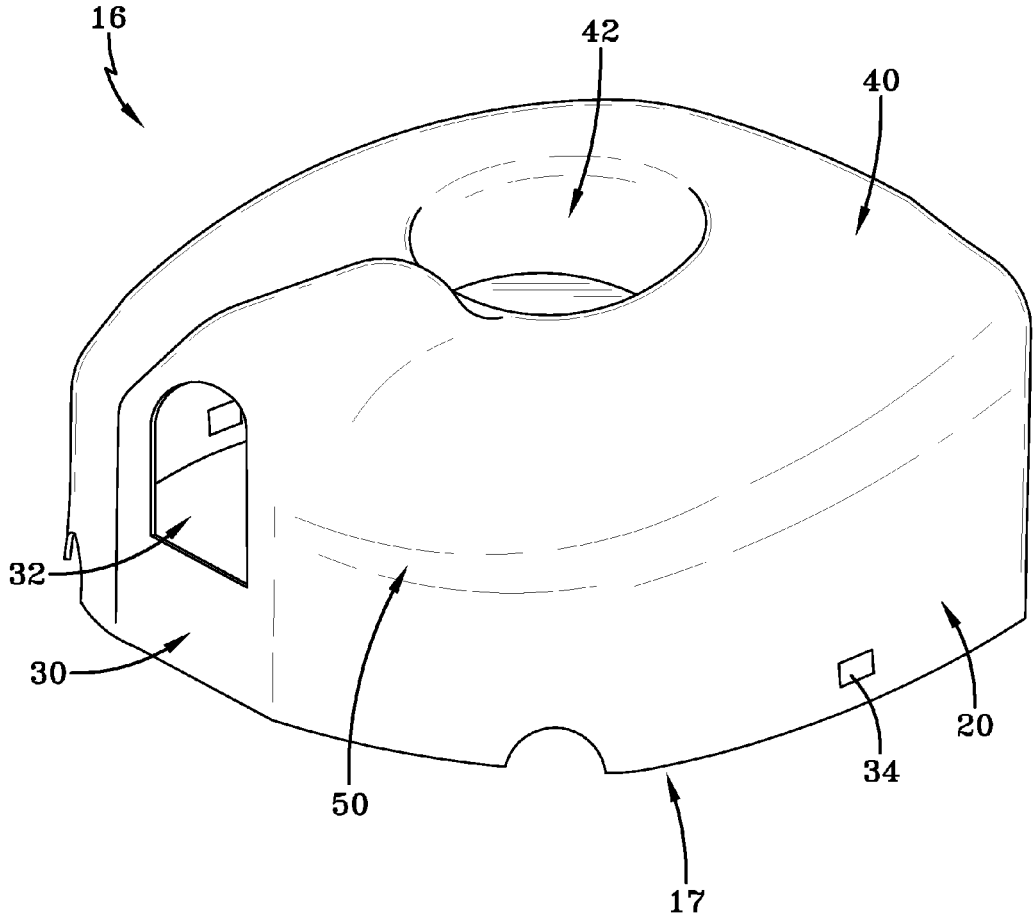
FIG. 2 is a three-quarter perspective view of the motor cap of the present invention.

FIG. 1 shows an embodiment of the suction gas feed assembly of the present invention for a hermetic compressor unit having a shell 10, an electric motor 12 which drives a compressor mechanism, assembly, or device (not shown) having pistons for compression of gas and ports or valves to control gas intake and exhaust. As shown, one end of the motor 12 is substantially unencumbered, i.e. the end of the motor 12 opposite the compressor mechanism. As shown in FIGS. 1 and 2, the feed assembly comprises a motor cap 16 having substantially a cylindrical circumferential side wall 20 and a closed top wall 40. The motor cap 16 includes an opening 17 disposed substantially opposite closed top wall 40. The circumferential side wall 20 extends from the opening 17 to the closed top wall 40, and thus the motor cap 16 has a shape generally similar to an inverted bowl.

Figure 3:
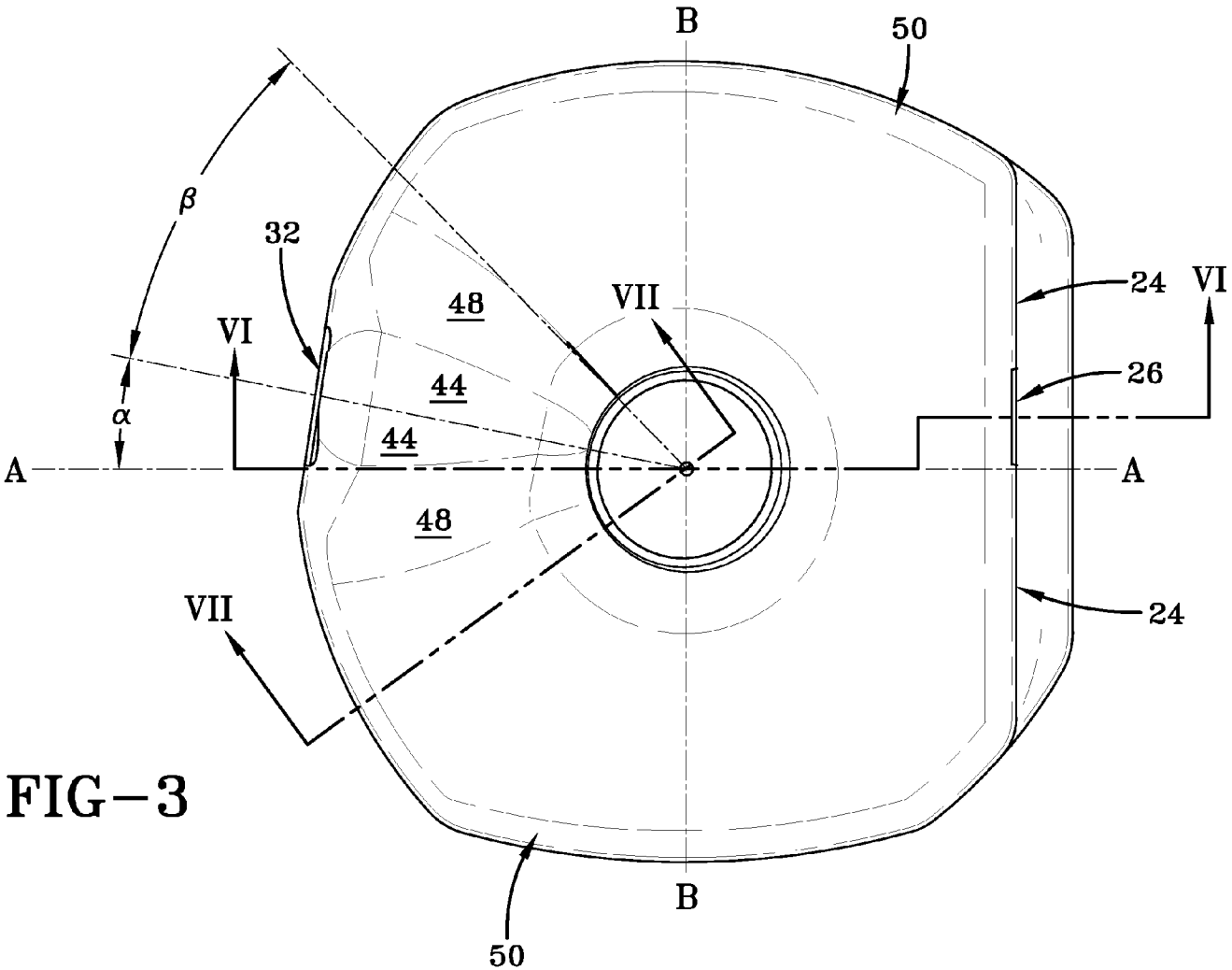
FIG. 3 is a top view of the motor cap of the present invention.
Figure 4:
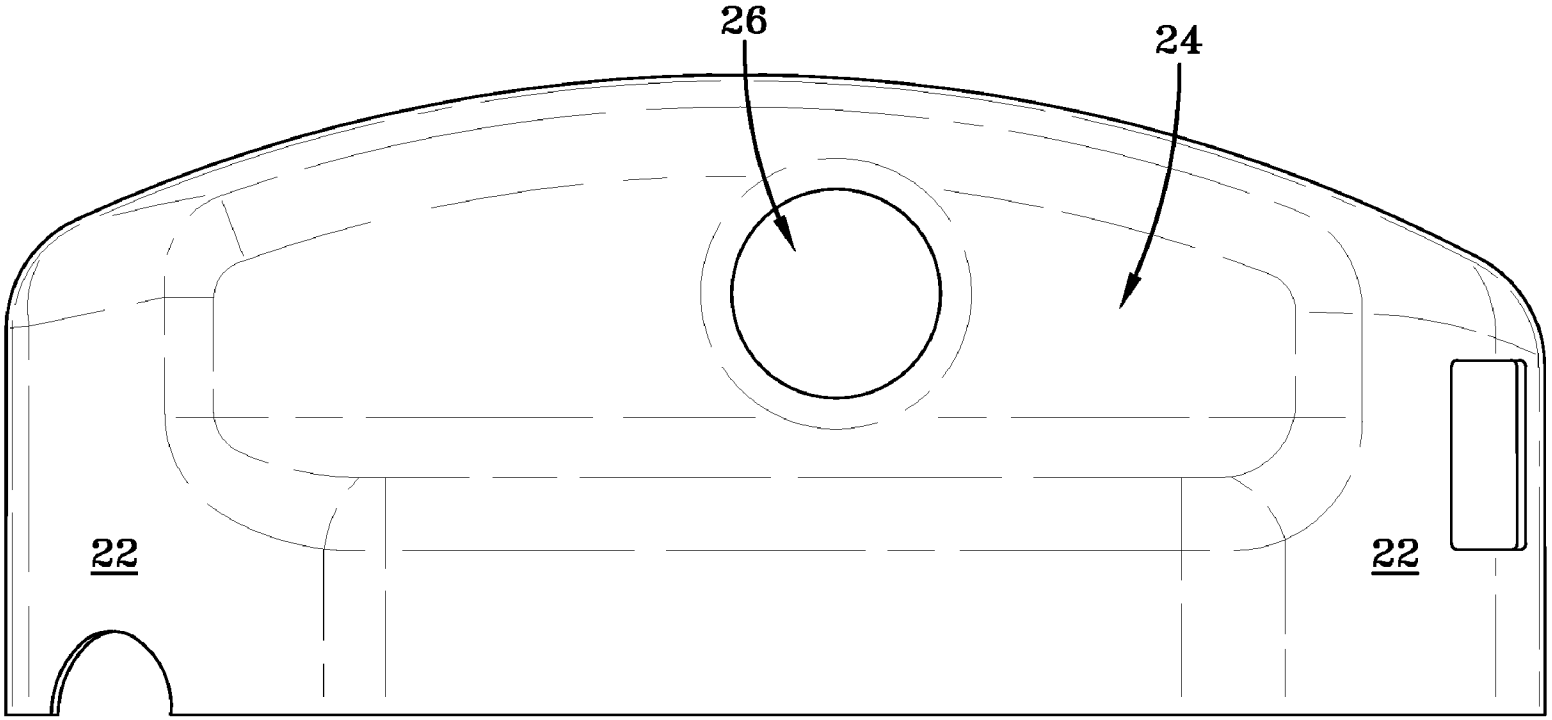
FIG. 4 is a front side view of the motor cap of the present invention.

The opening 17 is configured or adapted to be mounted in substantial sealing contact with the unencumbered end of the motor 12. Thus, when mounted, the motor cap 16 can serve as a suction plenum for the compressor by substantially enclosing the unencumbered end of the motor 12. The feed assembly of this embodiment further includes suction conduit 18 having one end mounted in a suction conduit aperture 26 (See FIGS. 3 and 4) located in the sidewall 20 of the motor cap 16 and the other end being connected to the compressor ports or valves for the communication of gas to the compressor mechanism. In FIGS. 1, 3, and 4, the suction conduit aperture 26 is located in a first substantially vertical panel section 24 located in the front portion 22 of the sidewall 20. As shown in FIG. 3, the suction conduit aperture 26 is preferably disposed in substantial vertical and horizontal alignment with a gas inlet aperture 32 located in a second substantially vertical panel section 30 of a substantially opposed portion 28 of the side wall 20. In a preferred embodiment, the gas inlet aperture 32 is also in substantial alignment with a gas return aperture 60 located in the shell 10, as shown in FIG. 1. For purposes of this application, "substantially aligned" or "in substantial alignment" means that the horizontal and vertical center of each of the respective features may be in direct vertical and horizontal alignment (no offset), or may be offset vertically and/or horizontally from about 1 degree to about 15 degrees. This aligned configuration of the gas return aperture 60 and the gas inlet aperture 32 provides a substantially uninterrupted flow of suction gas through the motor cap 16 to provide motor cooling, while minimizing superheat of the refrigerant gas.

As previously described, the opening 17 of the motor cap 16 is dimensioned to provide a substantially gas-tight frictional connection to the motor 12. For connection to motor 12, mounting mechanisms or means are provided on the circumferential sidewall 20 of motor cap 16 to assist in making a compressed, tight, sliding fit between the motor 12 and the motor cap 16. The mounting mechanisms can include mounting apertures 34 located along the circumferential sidewall 20 disposed or positioned so as to engage corresponding mounting clips, tabs, or bolts (not shown) on the motor 12. Preferably, at least two (2) mounting apertures 34 are provided, each spaced along the circumference of the sidewall 20. As shown in the drawing, the spacing is preferably at about every 180 degrees along the 360 degree circumference of the sidewall 20. The preferred spacing, combined with the contoured shape and dimensions of the motor cap 16 provide improved stiffness and decreased vibration and noise attenuation, while providing a good seal between the cap 16 and motor 12 for efficient gas suction and flow.

In preferred embodiments, as shown in FIG. 3, the motor cap 16 has a substantially circular horizontal geometry defined by a major axis (A—A) and a minor axis (B—B). The outer diameter of the motor cap measured along the major axis is preferably between about 4 to about 7 inches, and the diameter measured along the minor axis is preferably between about 3 to about 6 inches. In this embodiment, the opening 17 has an outer perimeter of between 15 and 25 inches, and a base area of between 25 and 40 square inches. This geometry provides the basis for proper alignment of the various motor cap 16 features such as the gas inlet aperture 32 and suction conduit aperture 26, as well as the other features of the motor cap 16 further described herein. For example, as shown in FIGS. 1 and 3, the suction conduit aperture 26 and the gas inlet aperture 32 are spaced apart a distance of from about one third to one-half of the total maximum circumferential dimension of the side wall 20, which dimension corresponds to the outer perimeter of the opening 17. Preferably, both the suction conduit aperture 26 and gas inlet aperture 32 are located in the same hemispherical section defined by the major axis A—A. This configuration creates a stronger uninterrupted flow through the hemisphere containing the apertures 26, 32.

As previously discussed, the gas inlet aperture 32 and suction conduit aperture 26 are preferably substantially opposed and are substantially aligned parallel to the major axis (A—A). More preferably, the gas inlet aperture 32 is offset from the major axis by between about one (1) to about twelve (12) degrees as shown by the angle $\alpha$ in FIG. 3, and the suction conduit aperture 26 is offset from the major axis (A—A) by about between zero (0) and about six (6) degrees. Preferably, the gas inlet aperture 32 and the suction conduit aperture 26 are mounted in substantially opposed, substantially vertical, substantially planar panel sections 30, 24 which panel sections 30, 24 are preferably disposed substantially parallel to the minor axis. More preferably, the gas inlet aperture 32 is also substantially aligned with a gas return aperture located in the compressor housing 10.

Figure 5:
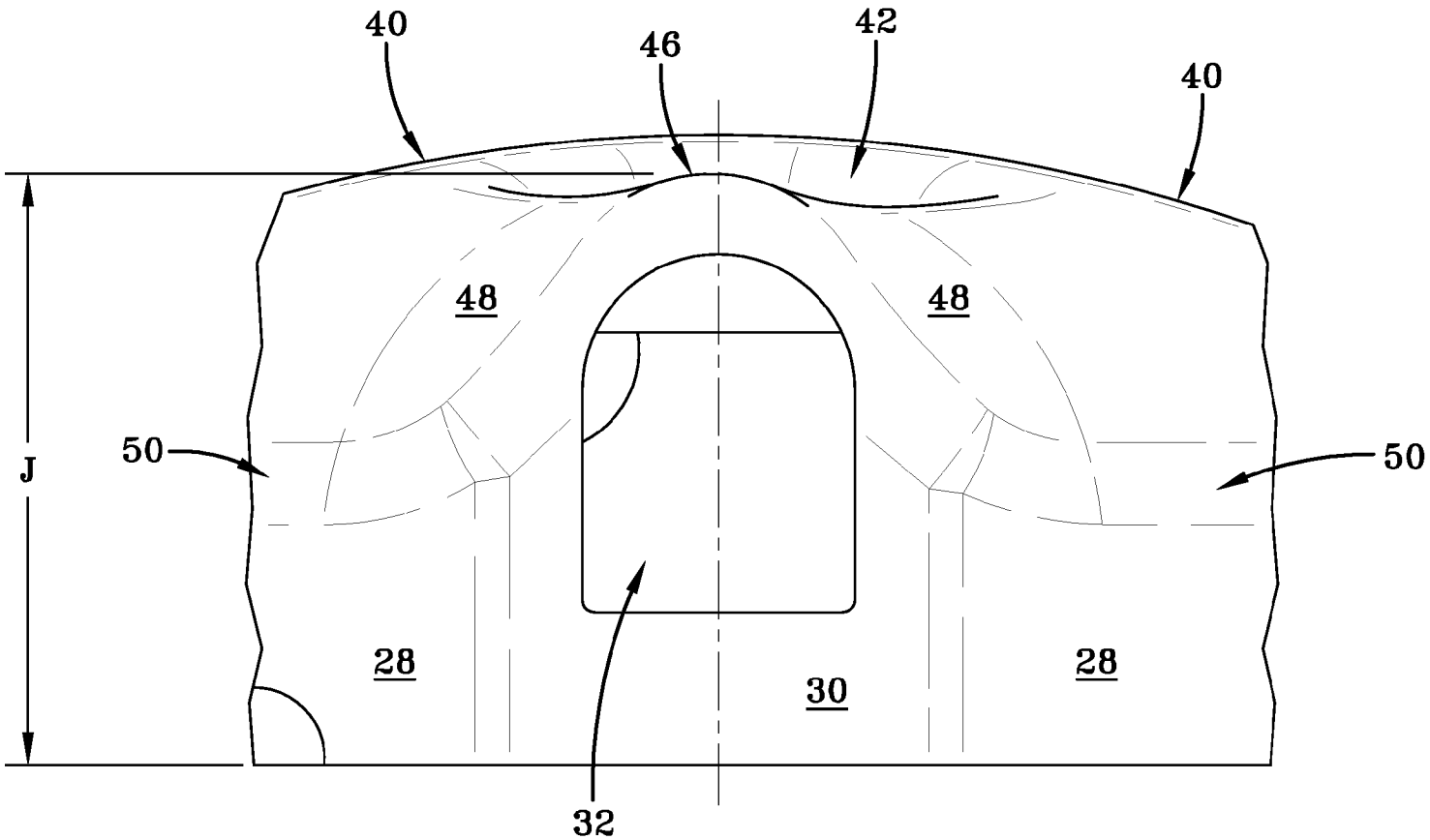
FIG. 5 is a rear side view of the motor cap of the present invention.
Figure 6:
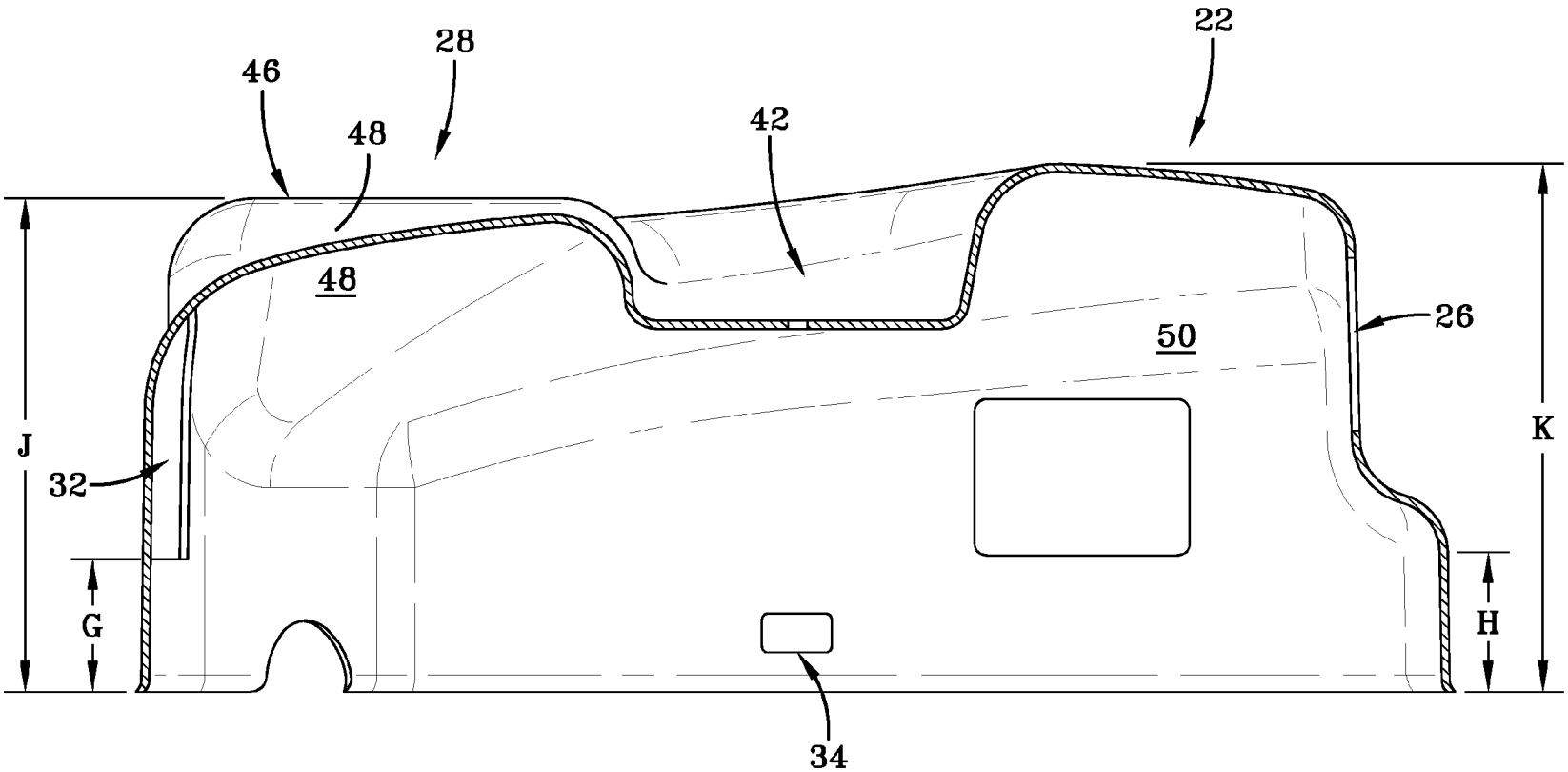
FIG. 6 is a side cross-sectional view of the motor cap of the present invention sectioned along line VI—VI of FIG. 3.
Figure 7:
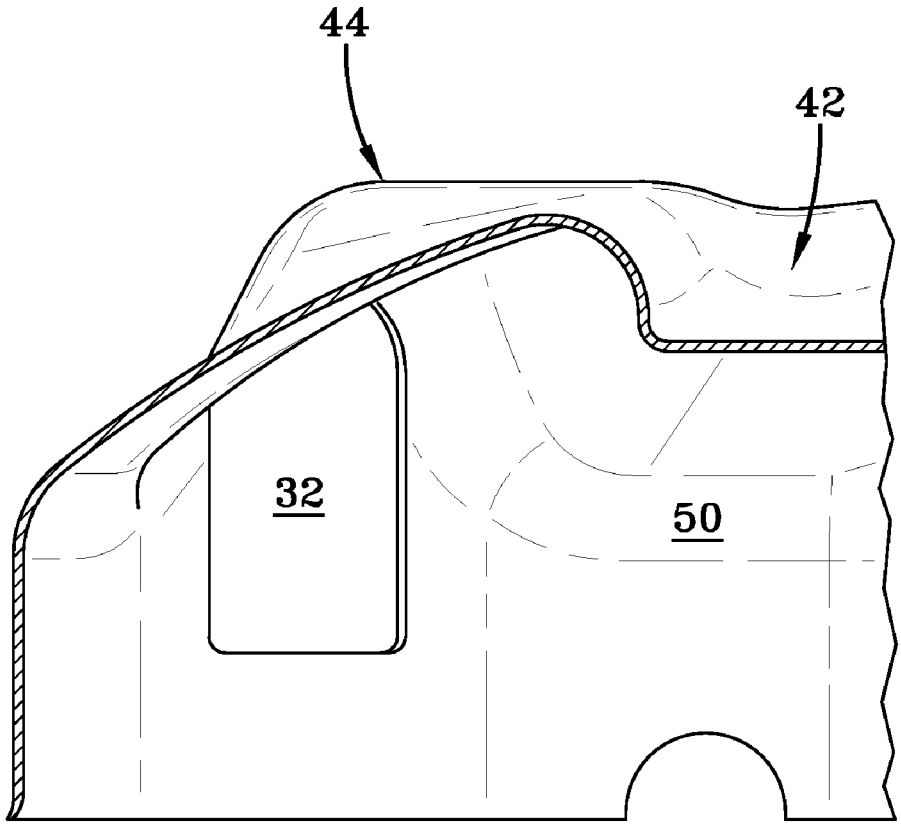
FIG. 7 is a side partial cross-sectional view of the motor cap taken along line VII—VII of FIG. 3.

FIGS. 2 and 5 provide a rear view of the motor cap 16 that show additional features of the motor cap 16. The gas inlet aperture 32 and the second substantially vertical panel section 30 are shown. The gas inlet aperture 32 is preferably located in the upper three-quarters of the panel section 30, thereby increasing the rigidity of the lower panel section adjacent the opening 17. As shown in FIG. 5, preferably, the height of the panel section 30 below the gas inlet aperture 32, represented by the height "G" in FIG. 6, is between 0.50 inches and 1.5 inches measured from the opening 17. Preferably, the shape of the aperture 32 mirrors the shape of the panel section 30, and is sized to include from about 40% to about 80% of the surface area of the panel section 30. To provide optimum suction gas flow, the height of the panel section 30 exceeds the height of the immediate adjacent sidewall portions by about 40–120%, and preferably by about 80–100%.

As shown in FIG. 4 and discussed above, the sidewall 20 preferably includes preferably includes a front portion 22 having a substantially vertical, substantially planar first panel portion 24 disposed substantially parallel to the minor axis (B-B). Preferably, the tallest point of the motor cap 16 as measured from the opening 17, such as represented by the height "K" in FIG. 6, is formed by the top wall 40 adjacent the first panel portion 22. More preferably, the tallest point of the motor cap 16 is formed by the top wall 40 adjacent the first panel portion 22 and the recessed cylindrical portion 42, and is between about 2.2 to 3.2 inches in height.

Preferably, the first panel portion 24 originates at the intersection with the top wall 40, and extends from about one half to two thirds of the length of the side wall 20. More preferably, the panel portion 24 extends downward from the top wall 40 about two-thirds of the height of the side wall 20 before transitioning into an outwardly curved arcuate front wall portion 25 that terminates at the open end 17. Most preferably, the outwardly curved arcuate front wall portion 25 includes a substantially vertical portion which is substantially parallel to the panel portion 24. In preferred embodiments, the height of the substantially vertical portion of the arcuate front wall portion 25, represented by the height "H" in FIG. 6, is between about 0.750 and 1.5 inches as measured from the opening 17. In the embodiment shown, the panel portion 24 also includes the suction conduit aperture 26, preferably in substantial alignment with the gas inlet aperture 32 located in the opposing rear portion 28 of the sidewall 20.

As shown in FIGS. 5 and 6, the side wall 20 and top wall 40 intersect to form an outwardly curved annular circumferential portion 50 extending around the circumference or perimeter of the motor cap 16. Other features of the top wall 40 are shown in FIGS. 1, 2, 3, 5, 6, and 7, including protruding and recessed portions which function to direct and control gas flow to provide a substantially uninterrupted flow through at least one hemisphere of the motor cap to provide strong suction, minimized superheat, and adequate motor cooling. For example, the top wall 40 includes a recessed cylindrical portion 42 which may be positioned anywhere on the top wall 40 of the motor cap 16. The function of the recessed cylindrical portion 42 is to reduce the internal volume of the motor cap 16 when mounted to the motor 12, while also providing a recessed portion for receiving a transportation stop, such as a spring mounting attached to the compressor housing or shell 10. Preferably, the recessed cylindrical portion 42 is positioned at the intersection of the major axis (A—A) and minor axis (B—B) of the horizontal geometry of the motor cap 16 at about the center of the top wall 40. Preferably, the longitudinal axis of the recessed cylindrical portion is substantially vertical. Most preferably, the longitudinal axis of the recessed cylindrical portion is substantially parallel to the panel portions 24 and 30. In the preferred embodiment, the diameter of the recessed cylindrical portion is between about 1.3 to 1.7 inches, and the depth of the recessed cylindrical portion is between about 0.60 to 0.80 inches as measured from the highest point on the top wall 40.

Another feature of the top wall 40 is a raised bridge portion 44 adjacent the rear panel section 30. The raised bridge portion 44 includes a longitudinal peak 46 and sloping portions 48. Preferably, the peak 46 is essentially horizontal, having a longitudinal axis which is in substantial alignment with the major axis (A—A). The peak 46 extends across the top wall 40 from the intersection with the raised second panel section 30 of the sidewall 20 to the recessed cylindrical portion 42. More preferably, the height of the peak, as shown by the height "J" in FIG. 6, is between about 2.0 to 3.0 inches as measured from the opening 17. The raised bridge portion 44 further includes at least two sloping portions 48 which originate at, and are centered on, the longitudinal axis of the peak 46. Preferably, the sloping portions are symmetric about the peak 46, and are annularly outwardly curved. More preferably, the sloping portions are annularly outwardly radially curved. As shown in FIG. 3, the sloping portions 48 collectively extend from about 15 degrees to about 80 degrees around the outwardly curved annular circumferential portion 50 of the motor cap 16. The sloping portions 48 form a tunnel-like chamber which acts to funnel incoming gas through the inlet aperture 32, across the motor end, and into the suction conduit aperture 26. In the preferred embodiment shown in FIG. 3, the peak 46 is directly aligned over the center of the inlet aperture 32, and the peak 46 and inlet aperture 32 are offset from about zero (0) to about twelve (12) degrees from the major (A—A) axis as shown by the angle $\alpha$ in FIG. 3. In this embodiment, the inlet aperture 32, peak 44, and suction aperture 26 are all located in the same hemisphere defined by the major axis. In this embodiment, the sloping portions 48 of the raised bridge portions are symmetric about the peak 46, and each sloping portion extends from about 8 to about 40 degrees around the outwardly curved annular circumferential portion 50 of the motor cap 16 as measured from the peak 46, and as shown by the angle $\beta$ in FIG. 3, before blending into the top wall 40. Preferably, the lowest height of the sidewall occurs immediately adjacent the point where each sloping portion 48 blends into the top wall 40.

The sloping portions 48, in combination with the recessed cylindrical portion 42, effectively reduce the volume of the motor cap 16, further improving gas flow and motor cooling by eliminating undesirable areas of flow within the cap 16. These recessed portions of the top wall 40, when combined with the protruding portions including the peak 44 and vertical panel sections 24, 30 create a substantially uninterrupted flow of suction gas through the motor cap. In the preferred embodiment having the apertures 26, 32 and the peak 44 all located in the same hemisphere as defined by the major axis, a strong substantially uninterrupted flow of refrigerant gas is created in that hemisphere, resulting excellent motor cooling and minimized superheat. This configuration further allows for additional motor protrusion into opposite hemisphere of motor cap 16 without significantly adversely affecting motor cooling, or suction gas flow and temperature.

For optimum performance, the volume and flow volume of the motor cap 16 must be considered. Preferably, the opening 17 of the motor cap 16 has a base area of between about 25 to 40 square inches, and the total internal volume of the motor cap 16 is between about 45 to 65 cubic inches. More preferably, the motor cap 16 retains a flow area volume of between 30–40 cubic inches when mounted on the motor 12 (as a result of motor protrusion(s) into the motor cap 16). Most preferably, the ratio of the flow area volume of the motor cap 16 when installed on the motor 12 to the volume of the uninstalled motor cap 16 is between 60% and 75%.

Another relevant relationship is that of the volume of the motor cap 16 relative to the volume of the compressor shell 10. In preferred embodiments, the motor cap 16 of the present invention is installed on a motor 12 and mounted within a compressor housing 10. For optimum performance, the compressor housing is generally cylindrical, and has a volume of between about 300 to about 450 cubic inches. More preferably, the ratio of the motor cap 16 volume in cubic inches to the compressor housing 10 volume in cubic inches is between about 12% to about 18%. Most preferably, the ratio of the net flow volume of the motor cap 16 when installed on the motor 12 to the total volume of the compressor housing 10 is between about 9% to about 15%.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A suction gas feed assembly for a hermetic compressor unit having an electric motor driven compressor mechanism mounted in the feed assembly comprising:

a motor cap comprising:

a circumferential sidewall, the sidewall comprising a suction conduit aperture and a gas inlet aperture, the suction conduit aperture being disposed opposite and in substantial alignment with the gas inlet aperture;

a top wall disposed adjacent the sidewall and being configured to form a closed end, the top wall comprising protruding portions and recessed portions, the protruding portions and recessed portions being configured and disposed to control and direct the flow of suction gas within the motor cap to provide a substantially uninterrupted flow of suction gas between the gas inlet aperture and suction conduit aperture;

an opening, the opening being disposed in substantial sealing contact with an unencumbered end of the motor to form a suction plenum for a compressor mechanism;

a suction conduit having a first end and a second end opposite the first end, the first end of the suction conduit being mounted in the suction conduit aperture in the sidewall, the second end of the suction conduit being configured for subsequent connection to compressor mechanism;

wherein the motor cap has a substantially cylindrical shape with a substantially straight sidewall, the sidewall having a substantially circular horizontal cross-sectional geometry defined by a major axis and a minor axis, the major axis dividing the motor cap into two hemispheres;

wherein the top wall and the sidewall intersect to form an outwardly curved annular circumferential portion extending around the perimeter of the end cap;

wherein the recessed portions of the top wall comprise a recessed cylindrical portion centered at the intersection of the major and minor axis;

wherein the protruding portions of the top wall comprise a raised bridge portion having a peak extending from the recessed cylindrical portion to the outwardly curved circumferential portion, the longitudinal axis of the peak in substantial alignment with the major axis; and wherein the suction conduit aperture, gas inlet aperture, and the peak are all located on one half hemisphere of the motor cap.

2. The feed assembly of claim 1, wherein the raised bridge portion further comprises two annularly curved symmetric sloping portions originating at, and centered on, the longitudinal axis of the peak, each annularly curved symmetric sloping portion extending from the recessed cylindrical portion to the outwardly curved circumferential portion and extending from about 8 degrees to about 40 degrees around the outwardly curved circumferential perimeter as measured from the peak.

3. The feed assembly of claim 2, wherein the suction conduit aperture and the gas inlet aperture are spaced apart a distance of from about one-third to about one-half of the total maximum circumferential dimension of the sidewall.

4. The feed assembly of claim 3, wherein the suction conduit aperture means and the gas inlet aperture means are in substantial alignment along the major axis.

5. The feed assembly of claim 4, wherein the sidewall further comprises it front portion having a first substantially vertical panel portion disposed substantially parallel to the minor axis, which first substantially vertical panel portion further comprises the suction conduit aperture means in substantial alignment with the gas inlet aperture means in an opposing portion of the sidewall.

6. The feed assembly of claim 5, wherein the first substantially vertical panel section is substantially planar.

7. The feed assembly of claim 6, wherein the sidewall further comprises a rear portion opposed to the front portion, the rear portion having a second substantially vertical panel portion disposed substantially parallel to the minor axis, which second substantially vertical panel portion further comprises the gas inlet in substantial alignment with the suction conduit aperture means in the opposing first substantially vertical panel portion of the sidewall.

8. The feed assembly of claim 7, wherein the second substantially vertical panel section is substantially planar.

9. The feed assembly of claim 8, wherein the height of the second substantially vertical rear panel portion exceeds the height of adjacent sidewall portions of the end cap by between about 40% to about 120%.

10. The feed assembly of claim 9, wherein the gas inlet aperture is in substantial alignment with a gas return aperture in the housing.

11. The feed assembly of claim 10 wherein the ratio of the volume of the motor cap to the total volume of the shell means is between about 12% to about 18%.

12. The feed assembly of claim 11 wherein the ratio of the net flow volume of motor cap installed on the motor to the total volume of the shell means is between about 9% to about 15%.

13. A motor cap for a hermetic compressor unit, the motor cap comprising:

a circumferential sidewall, the sidewall comprising suction conduit aperture and a gas inlet aperture, the suction conduit aperture being disposed opposite and in substantial alignment with the gas inlet aperture;

a top wall disposed adjacent the sidewall and being configured to from a closed end, the top wall comprising protruding portions and recessed portions, the protruding portions and recessed portions being configured and disposed to control and direct the flow of suction gas within the motor cap to provide a substantially uninterrupted flow of suction gas between the gas inlet aperture and suction conduit aperture;

an opening, the opening being disposed opposite the top wall and being adapted for subsequent mounting in substantial sealing contact with the unencumbered end of a motor;

wherein the motor cap has a substantially cylindrical shape with a substantially straight sidewall, the motor cap having a substantial circular horizontal cross-sectional geometry defined by a major axis and a minor axis, the major axis dividing the motor cap in two hemispheres;

wherein the top wall and the sidewall intersect to form an outwardly curved annular circumferential potion extending around the perimeter of the end cap;

wherein the recessed portions of the wall comprise a recessed cylindrical portion centered at the intersection of the major and minor axis;

wherein the protruding portions of the top wall comprise a raised bridge portion having a peak extending from the recessed cylindrical portion to the outwardly curved circumferential portion, the longitudinal axis of the peak in substantial alignment with the major axis; and wherein the suction conduit aperture, gas inlet aperture, and the peak are all located on one half hemisphere of the motor cap.

14. The motor cap of claim 13, wherein the raised bridge potion further comprises two annularly curved symmetric sloping portions originating at, and centered on, the longitudinal axis of the peak, each annularly curved symmetric sloping portion extending from the recessed cylindrical portion to the outwardly curved circumferential portion and extending from about 8 degrees to about 40 degrees around the outwardly curved circumferential perimeter as measured from the peak.

15. The motor cap of claim 14 wherein the suction conduit aperture means and the gas inlet aperture means are spaced apart a distance of from about one-third to one-half of the total maximum circumferential dimension of the sidewall.

16. The motor cap of claim 15, wherein the suction conduit aperture means and the gas inlet aperture means are in substantial alignment along the major axis.

17. The motor cap of claim 16, wherein the sidewall further comprises a front portion having a first substantially vertical panel portion disposed substantially parallel to the minor axis, which first substantially vertical panel portion further comprises the suction conduit aperture means in substantial alignment with the gas inlet aperture means in an opposing portion of the sidewall.

18. The motor cap of claim 17, wherein the first substantially vertical panel section is substantially planar.

19. The motor cap of claim 18, wherein the sidewall further comprises a rear portion opposed to the front portion, the rear portion having a second substantially vertical panel portion disposed substantially parallel to the minor axis, which second substantially vertical panel portion further comprises the gas inlet in substantial alignment with the suction conduit aperture means an the opposing first substantially vertical panel portion of the sidewall.

20. The motor cap of claim 19, wherein the second substantially vertical panel section is substantially planar.

21. The motor cup of claim 20, wherein the height of the second substantially vertical rear panel portion exceeds the height of the immediately adjacent sidewall by between about 40% to about 120%.

22. The motor cap of claim 21, wherein the gas inlet aperture is in substantial alignment with a gas return aperture in the housing.

23. The motor cap of claim 22 wherein the base area of the opening is between about 25 to about 40 square inches.

24. The motor cap of claim 23 wherein the volume of the motor cap is between about 45 to about 65 cubic inches.

* * * * *

UNITED STATES PATENT AND TRADEMARK OFFICE

CERTIFICATE OF CORRECTION

PATENT NO. : 7,070,397 B2
APPLICATION NO. : 10/427022
DATED : July 4, 2006
INVENTOR(S) : Narney, II et al.

It is certified that error appears in the above-identified patent and that said Letters Patent is hereby corrected as shown below:

Col, 8, Line 4: “to compressor” should be --to a compressor--

Col. 8, Line 43: “comprises it front” should be --comprises a front--

Col. 9, Line 10: “comprising suction” should be --comprising a suction--

Col. 9, Line 15: “to from a closed end” should be --to form a closed end--

Col. 9, Line 30: “cap in two” should be --cap into two--

Col. 9, Line 33: “circumferential potion” should be --circumferential portion--

Col. 9, Line 35: “of the wall” should be --of the top wall--

Col. 10, Line 30: “means an the opposing” should be --means in the opposing--

Signed and Sealed this

Twentieth Day of November, 2007

JON W. DUDAS
*Director of the United States Patent and Trademark Office*